US010669137B2

(12) United States Patent
Trail

(10) Patent No.: US 10,669,137 B2
(45) Date of Patent: Jun. 2, 2020

(54) HEAVE COMPENSATION SYSTEM

(71) Applicant: WT INDUSTRIES, LLC, Houston, TX (US)

(72) Inventor: Douglas Patrick Trail, Houston, TX (US)

(73) Assignee: WT INDUSTRIES, LLC, Houston, TX (US)

( * ) Notice: Subject to any disclaimer, the term of this patent is extended or adjusted under 35 U.S.C. 154(b) by 124 days.

(21) Appl. No.: 15/714,101

(22) Filed: Sep. 25, 2017

(65) Prior Publication Data

US 2019/0092610 A1 Mar. 28, 2019

(51) Int. Cl.

| | |
|---|---|
| ***B66D 1/52*** | (2006.01) |
| ***B66C 13/06*** | (2006.01) |
| ***B66C 13/02*** | (2006.01) |
| ***B66C 23/53*** | (2006.01) |

(52) U.S. Cl.

CPC ..... *B66D 1/525* (2013.01); *B66C 13/02* (2013.01); *B66C 13/063* (2013.01); *B66C 23/53* (2013.01); *B66D 1/52* (2013.01)

(58) Field of Classification Search

CPC ..... B66C 13/02; B66C 13/063; B66C 23/53; B66D 1/52; B66D 1/50; B66D 1/525; B66D 2700/0108; B66D 3/06; Y10S 254/90

See application file for complete search history.

(56) References Cited

U.S. PATENT DOCUMENTS

| | | | | |
|---|---|---|---|---|
| 3,150,860 | A * | 9/1964 | Nelson | B66D 1/48 114/244 |
| 3,343,810 | A * | 9/1967 | Parnell | B63B 21/16 254/273 |
| 3,871,527 | A * | 3/1975 | Schimmeyer | B66C 13/02 212/250 |
| 4,021,019 | A * | 5/1977 | Sanders | B66C 13/02 212/308 |
| 4,025,055 | A * | 5/1977 | Strolenberg | B66C 13/02 212/308 |
| 4,155,538 | A * | 5/1979 | Claassen | B66C 13/02 212/272 |
| 4,179,233 | A | 12/1979 | Bromell et al. | |
| 4,236,695 | A * | 12/1980 | Morrison | B66C 13/02 175/5 |
| 4,271,970 | A * | 6/1981 | Miller | B66C 13/02 212/232 |
| 4,285,502 | A * | 8/1981 | Lub | B66D 1/50 226/118.2 |
| 4,349,179 | A * | 9/1982 | Barber | B66C 13/02 114/245 |

(Continued)

FOREIGN PATENT DOCUMENTS

CN 106364630 A 2/2017

*Primary Examiner* — Michael E Gallion
(74) *Attorney, Agent, or Firm* — Rao DeBoer Osterrieder, PLLC; Dileep P. Rao

(57) ABSTRACT

A compact and simplified heave compensation system for reducing the effect of waves or wavelike movements on a lifting device. The system can have active and passive heave compensation components. An overload protection to protect lifting equipment can also be implemented. The system enables accurate load and displacement calculations, as well as simplifying the control schemes utilized for lifting devices.

15 Claims, 2 Drawing Sheets

(56) References Cited

U.S. PATENT DOCUMENTS

| | | | | | |
|---|---|---|---|---|---|
| 4,624,450 | A * | 11/1986 | Christison | B66D 1/52 | 254/272 |
| 4,724,970 | A | 2/1988 | Kuhn | | |
| 5,140,927 | A * | 8/1992 | Tolefson | B63B 39/02 | 114/244 |
| 5,351,430 | A * | 10/1994 | Hystad | A01K 73/06 | 254/273 |
| 5,894,895 | A * | 4/1999 | Welsh | B66C 13/02 | 175/40 |
| 7,389,889 | B2 * | 6/2008 | Roodenburg | B66C 13/02 | 212/308 |
| 7,461,831 | B2 * | 12/2008 | Mosley | E21B 7/023 | 254/277 |
| 7,731,157 | B2 * | 6/2010 | Davidson | B66D 1/525 | 254/277 |
| 7,798,471 | B2 * | 9/2010 | Christopher | B66C 13/02 | 254/277 |
| 9,174,705 | B2 * | 11/2015 | Eilertsen | B63B 21/16 | |
| 9,238,569 | B2 * | 1/2016 | Sorensen | B66C 23/185 | |
| 9,463,963 | B2 * | 10/2016 | Hey | B66C 23/52 | |
| 9,540,076 | B1 * | 1/2017 | Trail | B63B 27/08 | |
| 9,855,999 | B1 * | 1/2018 | Trail | B63B 27/08 | |
| 2013/0129452 | A1 * | 5/2013 | Vehmeijer | F16L 1/207 | 414/141.7 |
| 2016/0002012 | A1 | 1/2016 | Cannell et al. | | |

* cited by examiner

HEAVE COMPENSATION SYSTEM

FIELD

The present disclosure generally relates to a heave compensation system.

BACKGROUND

Lifting equipment, such as cranes or winches, are often in situations where a load must be delivered to a location which is moving relative to the load or the lifting equipment. Exemplary situations include transferring a load from a ship to the seabed, transferring a load from a ship to a floating platform, transferring a load from a ship to a dock, transferring a load from a dock to a ship, transferring a load from a ship to a ship, transferring a load from a floating platform to a ship, and the like.

The relative motion of the load with respect to the destination is problematic, as it is unpredictable and can result in unwanted collisions or snapping of the load line. This can cause damage to the load if placed in a more violent manner than intended, or if the load is collided with water surfaces. In other instances, sudden buoying of the load when lowered into water can cause unwanted snapping of the load line, or other undesirable resonant effects. Similarly, a load being lifted that snags, or is otherwise encumbered, can cause a structural overload in the lifting apparatus.

Often, heave compensation systems, whether active or passive, are utilized to correct for such relative motion. Exemplary active systems in use include electric winch systems, hydraulic winch systems, and cylinder compensation. An exemplary passive system can be a soft spring.

Present systems are complex and require considerable space. Expensive components are required to determine required heave compensation, as well as to implement the heave compensation.

A need exists for a compact, cost-effective and space saving heave compensation system which can provide both passive and active heave compensation as necessary. A further need exists for a simple system with fewer failure modes than existing systems.

The present disclosure meets these needs.

BRIEF DESCRIPTION OF THE DRAWINGS

The detailed description will be better understood in conjunction with the accompanying drawings as follows.

Figure 1:
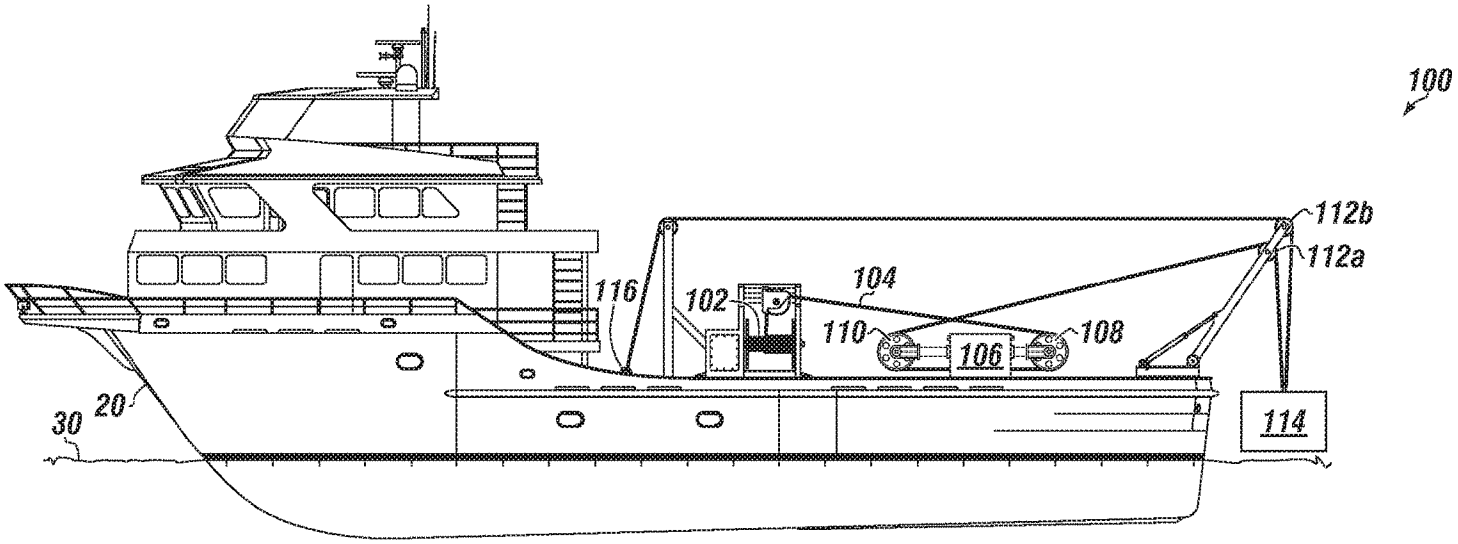
FIG. 1 depicts a heave compensation system according to one or more embodiments as installed on a ship.

The embodiments of the present disclosure are detailed below with reference to the listed Figures.

DETAILED DESCRIPTION OF THE EMBODIMENTS

Before explaining the present invention in detail, it is to be understood that the invention is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present invention. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a heave compensation system. Such systems can reduce the dynamic forces in a load line due to variable motion of the lifting point or the destination as well as act to reduce or eliminate the variable motion(s) between the lifting point and the destination. In alternate applications, the present disclosure can provide overload protection for lifting equipment.

The heave compensation system can have passive heave compensation and an overload protection. The heave compensation system can have a winch comprising a load line, a first actuator sheave for receiving the load line, a second actuator sheave for receiving the load line, an overboard sheave for receiving the load line, a load attached to the load line, and a passive heave component located opposite the overboard sheave from the load.

The term winch can refer to a crane, a hauling device, a lifting device, or other similar structure which can wind or play out a load line in a controlled fashion.

In embodiments, the winch comprises a load line. The load line can be wrapped around the first actuator sheave and the second actuator sheave. The actuator sheaves can have one or more grooves to guide the load line. In embodiments, there are a plurality of sheaves that can act as the first actuator sheave and/or the second actuator sheave. The load line can then be guided over the overboard sheave and attached to a load. In embodiments, the grooves can have rollers to facilitate the movement of the load line.

A passive heave component, an active heave component, or both a passive heave component and an active heave component can be in mechanical communication with the first actuator sheave and the second actuator sheave.

Current systems make use of passive heave compensation components between the overboard sheave and the load. The present disclosure is novel in that the passive and active heave compensation components can be located opposite the overboard sheave from the load. In embodiments, the heave compensation system can be installed on the boom of a crane, and provide accurate load weight information.

The first actuator sheave can be a flying sheave, the second actuator sheave can be a flying sheave, or both the first actuator sheave and the second actuator sheave can be flying sheaves. The term flying sheave indicates that the sheaves are mobile in a longitudinal fashion. The sheaves can themselves rotate, or have rollers to allow the load line to move freely. The overboard sheave is typically a fixed sheave, such as the sheave at the boom tip of a crane.

In embodiments, the passive heave component can have a piston which can be hydraulically loaded and a gas accumulator. The piston can be in mechanical communication with the actuator sheaves to move in concert with the actuator sheaves. The passive heave component can have a plurality of stages in various embodiments. In embodiments, the piston can be in fluid or hydraulic communication with the actuator sheaves.

In embodiments, the passive heave component can have an accumulator compartment for a back-pressure fluid. In embodiments, the housing for the passive heave component can serve as the structural enclosure, the accumulator compartment, and tension rod for the end caps of the housing.

In embodiments, the passive heave component can have a secondary passive overload safeguard to release the winch when a preset load limit or structural load limit is reached.

An active heave component can be in fluid communication with the passive heave component.

A heave compensation system with both a passive heave component and an active heave component can have a winch comprising a load line, a first actuator sheave for receiving the load line, a second actuator sheave for receiving the load line, an overboard sheave for receiving the load line, a load attached to the load line, a passive heave component comprising at least one cylinder and piston, and an active heave component comprising an actuator, an actuator position sensor, at least one cylinder and piston in mechanical communication with the actuator, an overboard sheave position sensor or a load position sensor, and a controller in electronic communication with the overboard sheave position sensor or the load position sensor and the actuator.

In embodiments, the at least one cylinder and piston can be in mechanical communication with one of the actuator sheaves to adjust the position of the actuator sheave. In embodiments, two cylinders and pistons can be employed to independently adjust the position of the first actuator sheave and the second actuator sheave.

The actuator can actuate the piston to adjust the position of the actuator sheave. An actuator position sensor can be employed to determine the position of the actuator, and therefore the position of the actuator sheave. In embodiments, the linear displacement of the actuator can be determined via various methods, such as counting the number of turns on a screw drive, the number of revolutions of a belt drive, or any other similar methods.

Based upon the number of turns of the load line about the actuator sheave, the amount of heave compensation can be accurately detected and/or calculated.

An overboard sheave position sensor can be used to determine how much heave compensation is necessary. Such a sensor can be mounted on any portion of a crane, or structure supporting an overboard sheave. While the most simplified placement is at the overboard sheave, any location on a support structure allows for the calculation of overboard sheave position in conjunction with existing sensors.

Persons having ordinary skill in the art will be conversant with motion reference units (MRUs) currently employed on ships. If present, the MRU can be utilized to determine the amount of heave needing to be corrected. In addition, or in lieu of an overboard sheave position sensor or MRU, a load position sensor can be utilized to determine an exact position of the load.

In embodiments, the overboard sheave position sensor or the load position sensor can employ various sensors to determine distance to a destination of the load, distance to the load from the overboard sheave, or exact position of a load. Exemplary sensors include, but are not limited to: laser range finders, radar range finders, altimeters, accelerometers, a dual sensor arrangement with a sensor on the overboard sheave and a sensor on the load destination, and the like. The overboard sheave position sensor's main function is to determine what the variable motion is between the load lifting point and destination, and convey this information to the controller.

In embodiments, the overboard sheave position sensor or the load position sensor can be placed at or on the load.

The controller can be any device comprising a processor, a data storage comprising a non-volatile data storage medium, and computer instructions executed by the processor to manipulate the actuator.

In embodiments, the heave compensation system can be combined with a launch and recovery system for a remotely operated vehicle, wherein a weight bearing rail of the launch and recovery system can house a passive heave component, an active heave component, or both a passive heave component and an active heave component.

The present disclosure is best understood with a use case. While the use case below makes use of a ship delivering a load to water, the principles described are equally applicable to other uses. The use case concerns a remotely operated vehicle (ROV) being deployed from a ship.

The ship can have a winch or a crane with a load line attached. The load line can then be wrapped around a first and second actuator sheave. The first and second actuator sheaves can be connected to a heave compensation system comprising both a passive heave component and an active heave component. The load line can be wrapped around the actuator sheaves multiple times in order to allow for greater corrective capability.

The passive heave component can have multiple stage of passive heave protection. Exemplary stages for an ROV launch and recovery system can include: a first stage being somewhat less than the total weight of the ROV system, in order to prevent line snapping when the ROV is in the splash zone, or first encountering waves and entering the water, a second stage for a weight greater than the weight of the ROV system when the ROV system is deployed in water, and a third stage for a predetermined overload weight for runaway situations or when structural limits are reached.

The heave protection stages of the passive heave component can be designed by utilizing multiple cylinders and pistons, and adjusting the effective diameters of the cylinders and pistons used. The pistons can thereby be independently actuated based upon a working fluid pressure. An increase in the load can cause the actuator sheaves to collapse toward a housing of the heave compensation system. A decrease in the load can cause the actuator sheaves to extend outward and gather any slack in the load line.

The heave protection of the active heave component can be accomplished by actuating the first and/or second actuator sheaves. A controller for an actuator can be utilized. The controller can be a computer, or any device comprising a processor and a non-volatile data storage medium with instructions executable by the processor. The controller can receive information from an overboard sheave position sensor or a load position sensor, and actuate the first and/or second actuator sheaves to compensate for changes in the position due to heave.

While the specific logic utilized by the controller is not material to this disclosure, persons having ordinary skill in the art will recognize that various control schema can be implemented as desired based upon the desired level of heave compensation.

The actuator can be any actuation mechanism known to persons having ordinary skill in the art. Exemplary actuators include hydraulic, pneumatic, mechanical, magnetic, and electrical actuators.

Commonly used are hydraulic systems to actuate the heave compensation system using pressurized fluid, or mechanical systems. Any linear actuator known to persons having ordinary skill in the art can be utilized. The use of a linear actuator provides the added benefit of being able to clearly determine actuator position, and therefore actuator sheave position, with great accuracy. For example, the number of turns of a linear screw actuator can be tracked to determine an actuator position.

Turning now to the Figures, FIG. 1 depicts a heave compensation system according to one or more embodiments as installed on a ship.

Ship 20 can be floating in a body of water with a waterline 30. Wave action can make the waterline 30 irregularly shaped, or cause the ship 20 to move with respect to waterline 30. This can cause the load 114 to be displaced with respect to waterline 30.

In the embodiment shown, the heave compensation system 100 can comprise a winch 102 with a load line 104. The heave compensation system 100 can comprise a passive heave component, an active heave component, or both components, which can be provided on ship 20. The load line 104 is wrapped around a first actuator sheave 108 and a second actuator sheave 110. In embodiments, the load line 104 can be wrapped around each sheave a plurality of times in order to allow for greater heave compensation distance.

Figure 2:
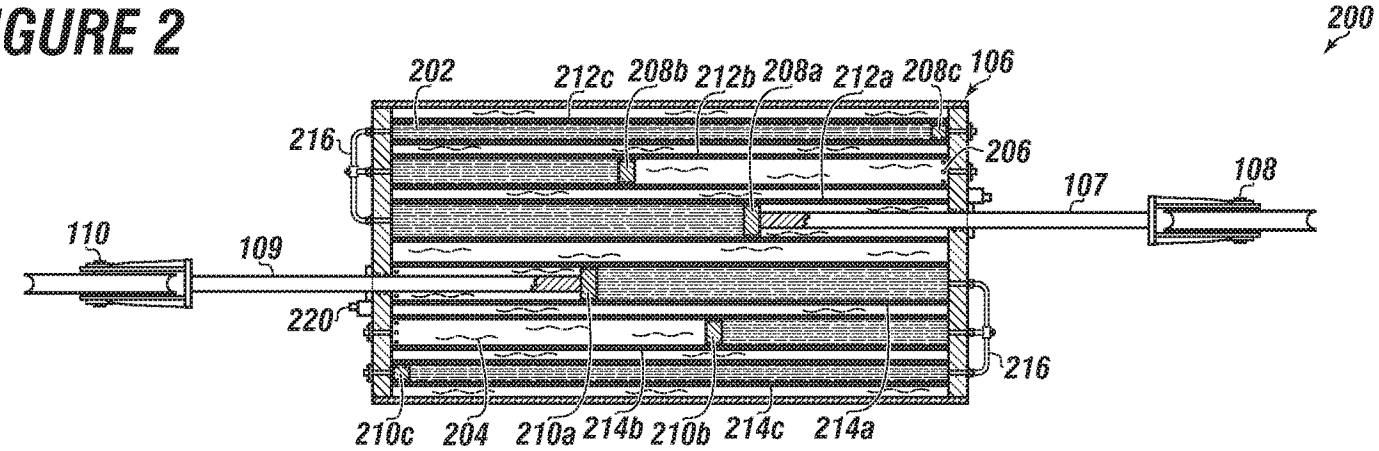
FIG. 2 depicts a passive heave component according to one or more embodiments.

At least one of the first actuator sheave 108 and the second actuator sheave 110 is a flying sheave, i.e. able to be displaced longitudinally along the axis of at least one support 107 and 109 respectively, shown in FIG. 2. In embodiments, both the first actuator sheave 108 and the second actuator sheave 110 can be flying sheaves.

While first actuator sheave 108 and second actuator sheave 110 are shown as rotatable wheels, it is contemplated that guides which do not rotate can be utilized to receive the load line. Embodiments can have rollers to facilitate the movement of the load line.

The load line 104 can then be received by an overboard sheave 112*a* and attached to the load 114. In embodiments, the load line can return through a second overboard sheave 112*b* to attach to an anchor point 116. Alternatively, the load line 104 can be attached to the load 114.

In embodiments, the position of the winch and the anchor point can be reversed. This arrangement can provide the added benefit of having only one portion of the load line 104 being cycled through a housing 106 of the heave compensation system 100. Therefore, cycling of the load line 104 can be accurately tracked, making maintenance and replacement of the load line 104 simpler. In further embodiments, a plurality of heave compensation systems can be utilized with at least one system proximate the winch and the anchor point.

FIG. 2 depicts a passive heave component according to one or more embodiments.

The heave compensation system can comprise a passive heave component 200. Schematically shown here are first actuator sheave 108 and second actuator sheave 110, both supplied in a flying orientation, i.e. able to be displaced longitudinally along the axis of support 107 and support 109 respectively. In embodiments, the sheaves can be tilted or angled with respect to each other to simplify cabling of the load line between the first actuator sheave 108 and the second actuator sheave 110.

Actuator sheave 108 can be in mechanical communication with piston 208*a* via support rod 107. Cylinder 212*a* can house piston 208*a*, a hydraulic fluid 202, and a back-pressure fluid 204. In embodiments, multiple cylinders with the same or different diameters can be utilized to allow for multiple stages of passive heave compensation.

In the example shown, cylinders 212*b* and 212*c* can be utilized with additional pistons 208*b* and 208*c*. Cylinders can be in fluid communication via a manifold 216.

In the embodiment shown, the surface areas of pistons 208*a*, 208*b*, and 208*c* are different, thereby allowing of independent movement based upon pressure.

The back-pressure fluid can be pressurized as desired to balance a desired load condition. Back-pressure fluid can vent from the cylinders to an accumulator via vent holes 206. The present embodiment shown allows for the housing 106 to act as the accumulator, thereby minimizing the space required by the heave compensation system.

Similarly, actuator sheave 110 can be in mechanical communication with piston 210*a* via support rod 109. Cylinder 214*a* can house piston 210*a*, a hydraulic fluid 202, and a back-pressure fluid 204. In embodiments, multiple cylinders with the same or different diameters can be utilized to allow for multiple stages of passive heave compensation.

In the example shown, cylinders 214*b* and 214*c* can be utilized with additional pistons 210*b* and 210*c*. Cylinders can be in fluid communication via a manifold.

In the embodiment shown, the surface areas of pistons 210*a*, 210*b*, and 210*c* are different, thereby allowing of independent movement based upon pressure.

In embodiments, the passive heave component 200 can have a secondary passive overload safeguard 220 to release the winch when a preset load limit or structural load limit is reached. As the actuator sheaves collapse, a switch can be actuated. The embodiment shown is a mechanical switch actuated by contacting actuator sheave 110.

Use of pressure sensors within the system can provide the additional capability of determining actual load. With known system parameters for the heave compensation system, an accurate load reading can easily be calculated.

In embodiments, the heave compensation system can be used with pressure sensors in conjunction with a winch control system to operate the winch in a constant tension mode. Such a mode can be utilized in situations in which an overload is possible, such as when a crane is attempting to lift a landed load which can be stuck in mud.

The back-pressure fluid can be pressurized as desired to balance a known load. Back-pressure fluid can vent from the cylinders to an accumulator via vent holes 206. The present embodiment shown allows for the housing 106 to act as the accumulator, thereby minimizing the space required by the heave compensation system.

While each actuator sheave in the embodiment shown can utilize identical hydraulic fluids, back-pressure fluid, and a common accumulator, this need not be the case. Persons having ordinary skill in the art will recognize that pressures can be adjusted based upon space constraints, desired range of travel of actuator sheaves, or any other considerations for specific installations and applications. Multiple stages of passive heave compensation can be thereby achieved with the use of multiple cylinders and pistons, as well as adjusting hydraulic fluids and back-pressure fluids.

The heave compensation system can comprise a secondary overload safeguard 220. In an instance where the load limits of the heave compensation system are exceeded, actuator sheave 110 can come in contact with the secondary overload safeguard 220. Shown here as a passive mechanical device, this switch can release the clutch of the winch to prevent damage to equipment. Examples of such overloads are when a vessel deploying an ROV loses a control signal and "runs off", or when a load on a crane is stuck and causes the crane to exceed structural limits.

Figure 3:
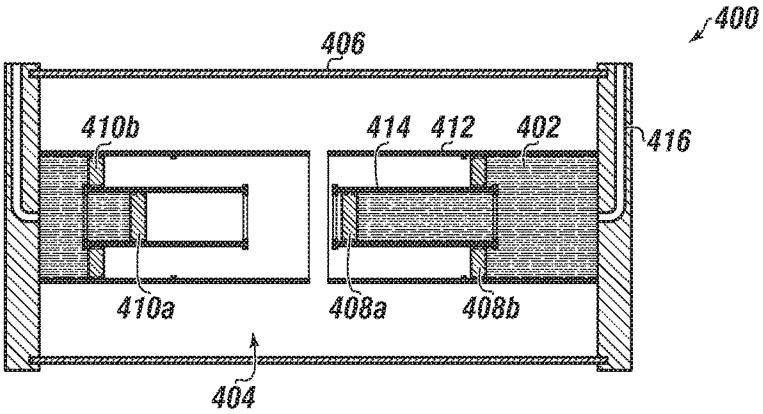
FIG. 3 depicts a multi stage passive heave component according to one or more embodiments.

FIG. 3 depicts a multi stage passive heave component according to one or more embodiments.

In embodiments, the multi stage passive heave component 400 can contain a housing 406, which can act as an accumulator for back-pressure fluid 404. In embodiments, cylinder 414 can be placed concentric to cylinder 412. In embodiments, hydraulic fluid 402 can be supplied via a fluid pathway 416, which can be integrated into the end caps of housing 406.

The surface areas of internal pistons 408*a* and 410*a* can be different from the surface area of external pistons 408*b* and 410*b*, thereby allowing for multi stage passive protection as discussed above.

Piston 410*a* is shown with a lower hydraulic fluid pressure. Piston 408*a* is shown with a higher hydraulic fluid pressure, causing both piston 408*a* and 408*b* to travel.

Figure 4:
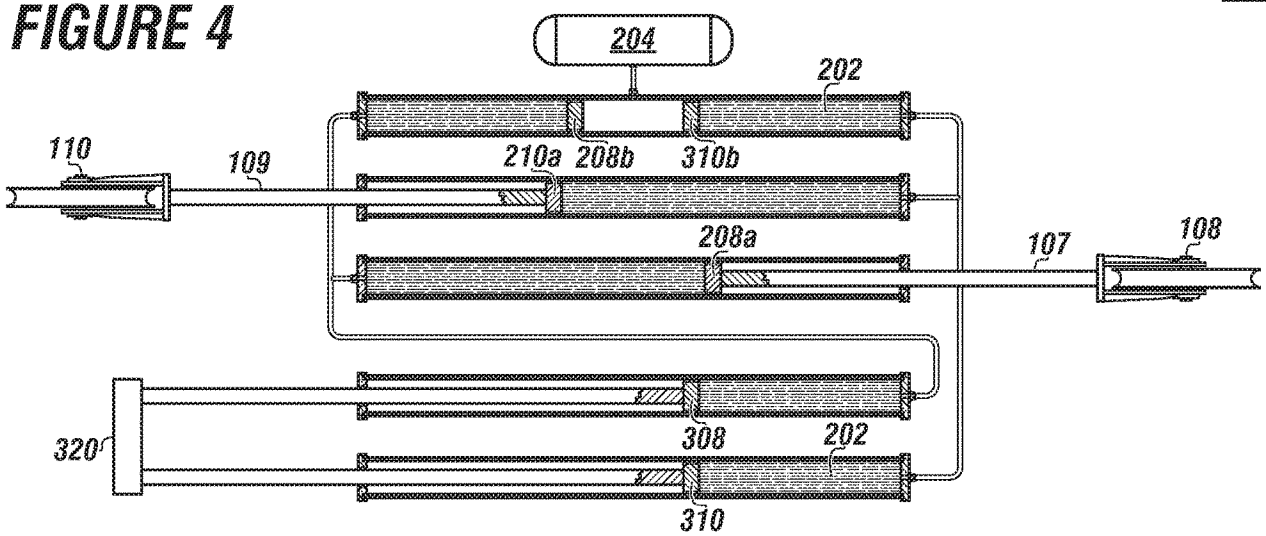
FIG. 4 depicts a schematic of a heave compensation system according to one or more embodiments with both an active heave component and a passive heave component.

FIG. 4 depicts a schematic of a heave compensation system according to one or more embodiments with both an active heave component and a passive heave component.

The heave compensation system can comprise an active heave component. Schematically shown here are first actuator sheave 108 and second actuator sheave 110, both supplied in a flying orientation, i.e. able to be displaced longitudinally along the axis of support 107 and support 109 respectively.

The active heave component can utilize an actuator 320 to apply pressure to piston 308 in communication with first actuator sheave 108, or apply pressure to piston 310 in communication with second actuator sheave 110. Actuation of the pistons can displace the first actuator sheave 108 and the second actuator sheave 110 longitudinally, along the axis of supports 107 and 109 respectively.

The actuator 320 can drive pistons 308 and 310 in conjunction as shown, or two separate actuators can be utilized to drive the pistons independently. In embodiments, the actuators can act independently at different settings. Other modifications to the shown embodiments include, but are not limited to: varying hydraulic fluids to achieve different movement between actuator sheaves, varying lengths of actuators, varying back pressure to pistons, and the like.

The actuator can be any known to persons having ordinary skill in the art. Exemplary methods include, but are not limited to: a hydraulics system, linear gear drive, a screw drive, a reciprocating gear drive, and the like.

In the embodiment shown, the system can function as a passive heave component when not actuated.

Figure 5:
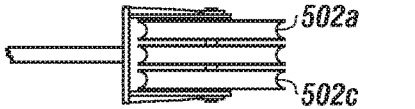
FIG. 5 depicts an alternate arrangement for an actuating sheave according to one or more embodiments.

FIG. 5 depicts an alternate arrangement for an actuating sheave according to one or more embodiments.

In embodiments, an actuating sheave 500 can have a plurality of sheaves 502*a*-502*c*, allowing for a load line to be wrapped multiple times around the actuating sheave 500.

While the present disclosure emphasizes the embodiments, it should be understood that within the scope of the appended claims, the invention might be practiced other than as specifically described herein.

What is claimed is:

1. A heave compensation system with passive heave compensation comprising:

a a winch comprising a load line;

b a first actuator sheave for receiving the load line;

c a second actuator sheave for receiving the load line;

d an overboard sheave for receiving the load line;

e a load attached to the load line; and f a passive heave component located opposite the overboard sheave from the load comprising a plurality of interconnected cylinders, wherein motion of the actuator sheaves compresses or decompresses a fluid within the plurality of interconnected cylinders; and wherein the first actuator sheave is flying, the second actuator sheave is flying, or both the first actuator sheave and the second actuator sheave are flying.

2. The system of claim 1, wherein the passive heave component comprises a plurality of stages.

3. The system of claim 1, wherein the passive heave component comprises an accumulator compartment which serves as a tension rod.

4. The system of claim 1, wherein the first actuator sheave comprises a plurality of sheaves or a plurality of grooves on the first actuator sheave for receiving the load line.

5. The system of claim 1, wherein the second actuator sheave comprises a plurality of sheaves or a plurality of grooves on the second actuator sheave for receiving the load line.

6. The system of claim 1, further comprising a secondary passive overload safeguard to release the winch.

7. The system of claim 2, wherein the plurality of stages are concentric cylinders.

8. A heave compensation system with active heave compensation comprising:

a a winch comprising a load line;

b a first actuator sheave for receiving the load line;

c a second actuator sheave for receiving the load line;

d an overboard sheave for receiving the load line;

e a load attached to the load line;

f a passive heave component comprising a plurality of interconnected cylinders, wherein motion of the actuator sheaves compresses or decompresses a fluid within the plurality of interconnected cylinders and a piston;

g an active heave component comprising:
i an actuator; and
ii an actuator position sensor;
h an overboard sheave position sensor or a load position sensor; and
i a controller in communication with the overboard sheave position sensor.

9. The system of claim 8, further comprising a motion reference unit to sense a change in height of a boom tip.

10. The system of claim 8, further comprising a load position sensor.

11. The system of claim 8, further comprising a launch and recovery system for a remotely operated vehicle, wherein a weight bearing rail of the launch and recovery system houses the passive heave component, the active heave component, or both the passive heave component and the active heave component.

12. A heave compensation system with active heave compensation comprising:
a an anchor point securing a load line;
b a first actuator sheave for receiving the load line;
c a second actuator sheave for receiving the load line;
d an overboard sheave for receiving the load line;
e a load attached to the load line;
f a passive heave component comprising a plurality of interconnected cylinders, wherein motion of the actuator sheaves compresses or decompresses a fluid within the plurality of interconnected cylinders and a piston;
g an active heave component comprising:
i an actuator;
ii an actuator position sensor;
iii an overboard sheave position sensor or a load position sensor; and
iv a controller in communication with the overboard sheave position sensor or the load position sensor; and
h a winch to receive the load line; and
wherein the first actuator sheave is flying, the second actuator sheave is flying, or both the first actuator sheave and the second actuator sheave are flying.

13. The system of claim 12, further comprising a motion reference unit to sense a change in height of a boom tip.

14. The system of claim 12, further comprising a load position sensor.

15. The system of claim 12, further comprising a launch and recovery system for a remotely operated vehicle, wherein a weight bearing rail of the launch and recovery system houses the passive heave component, the active heave component, or both the passive heave component and the active heave component.

* * * * *